US006722918B2

(12) United States Patent
McCoy

(10) Patent No.: US 6,722,918 B2
(45) Date of Patent: Apr. 20, 2004

(54) RAIL ELECTRICAL CONNECTOR SYSTEM

(75) Inventor: Phillip McCoy, Albion, IN (US)

(73) Assignee: Lyall Assemblies, Inc., Albion, IN (US)

( * ) Notice: Subject to any disclaimer, the term of this patent is extended or adjusted under 35 U.S.C. 154(b) by 26 days.

(21) Appl. No.: 10/139,951

(22) Filed: May 6, 2002

(65) Prior Publication Data

US 2003/0207612 A1 Nov. 6, 2003

(51) Int. Cl.[7] ..... H01R 13/60
(52) U.S. Cl. ..... 439/533; 439/121; 439/110
(58) Field of Search ..... 439/533, 121, 439/110, 532, 576, 540.1, 527, 214, 215, 216, 529, 537; 248/906; 174/48, 49

(56) References Cited

U.S. PATENT DOCUMENTS 3,790,915 A * 2/1974 Dugan et al. ..... 439/372
4,201,437 A * 5/1980 Lockyer ..... 439/372
5,647,763 A * 7/1997 Arnold et al. ..... 439/540.1
5,658,166 A * 8/1997 Freeman et al. ..... 439/540.1
6,077,113 A * 6/2000 Lecomte ..... 439/540.1
6,086,415 A * 7/2000 Sanchez et al. ..... 439/540.1
6,483,025 B1 * 11/2002 Samsi et al. ..... 174/48

* cited by examiner

*Primary Examiner*—Ross Gushi
(74) *Attorney, Agent, or Firm*—Taylor & Aust, P.C.

(57) ABSTRACT

A connector assembly includes a rail having a plurality of apertures therethrough, and two electrical connectors including a first electrical connector and a second electrical connector, the first electrical connector detachably mateable to the second electrical connector, the first electrical connector and the second electrical connector removably connected to the rail, at least one of the two electrical connectors being routed through at least one of the plurality of apertures.

18 Claims, 3 Drawing Sheets

RAIL ELECTRICAL CONNECTOR SYSTEM

BACKGROUND OF THE INVENTION

1. Field of the Invention

The present invention relates to an electrical connector system, and, more particularly, to a rail electrical connector system.

2. Description of the Related Art

Suspended ceilings are common place in commercial buildings allowing heating, plumbing and mechanical systems in commercial buildings to be hidden from view in an inexpensive manner. Suspended ceilings include metal rails that are suspended by wires from the structural ceiling and ceiling tile to lay on the metal rails. Light fixtures are often used in the place of certain tiles to provide illumination to the room.

Since a suspended ceiling is essentially a large overhead plenum, heating/cooling designers often will use the space above the suspended ceiling as one part of their air handling ductwork, thereby saving money. To accommodate the installation of lighting fixtures to the suspended ceiling, rails with apertures are often utilized to facilitate the attachment of the lighting fixture thereto with a retaining mechanism.

Power distribution from above a suspended ceiling is accomplished by cutting portions from ceiling tiles to accommodate the running of conduit or power risers therethrough. The electrical wiring is then connected from a distribution source above the suspended ceiling to a lighting fixture, electrical receptacles, an electrical load or a distribution system in the commercial space. A problem with this manner of distributing power is that a remodeling of the commercial space requires the disconnection of the wiring back to the distribution'source above the suspended ceiling.

Another problem with power distribution as just described is that it causes the ceiling tiles, which are cut, not to be reusable.

Yet another problem with the current manner of power distribution is that the aesthetic look of the ceiling suffers from having conduit and/or power risers going through ceiling tile.

What is needed in the art is an apparatus which provides for the distribution of electrical power that need not be routed through ceiling tiles and which would not require disconnection of electrical power at a distribution source when commercial space is remodeled.

SUMMARY OF THE INVENTION

The present invention provides an electrical connector system which provides for the distribution of electrical power through a suspended ceiling system.

The invention comprises, in one form thereof, a connector assembly including a rail having a plurality of apertures therethrough, and two electrical connectors including a first electrical connector and a second electrical connector, the first electrical connector detachably mateable to the second electrical connector, the first electrical connector and the second electrical connector removably connected to the rail, at least one of the two electrical connectors being routed through at least one of the plurality of apertures.

An advantage of the present invention is that electrical power can be connected and disconnected at the suspended ceiling rather than at a point of distribution.

Another advantage is that power distribution is accomplished through the rails, thereby leaving the ceiling tiles uncut.

Yet another advantage is that the suspended ceiling retains a more aesthetic appearance.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
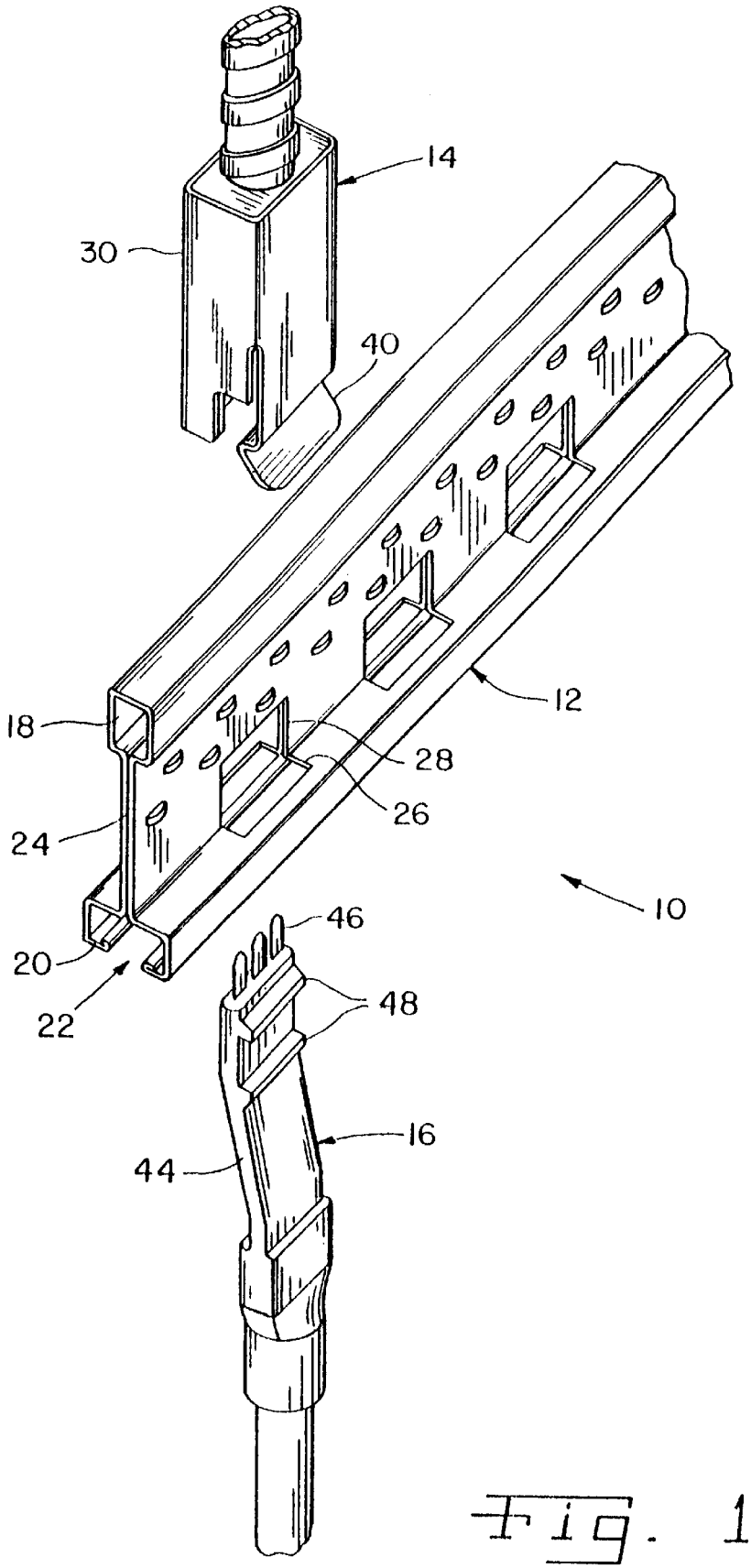
FIG. 1 is a perspective view of an embodiment of a rail connector system of the present invention.
Figure 2:
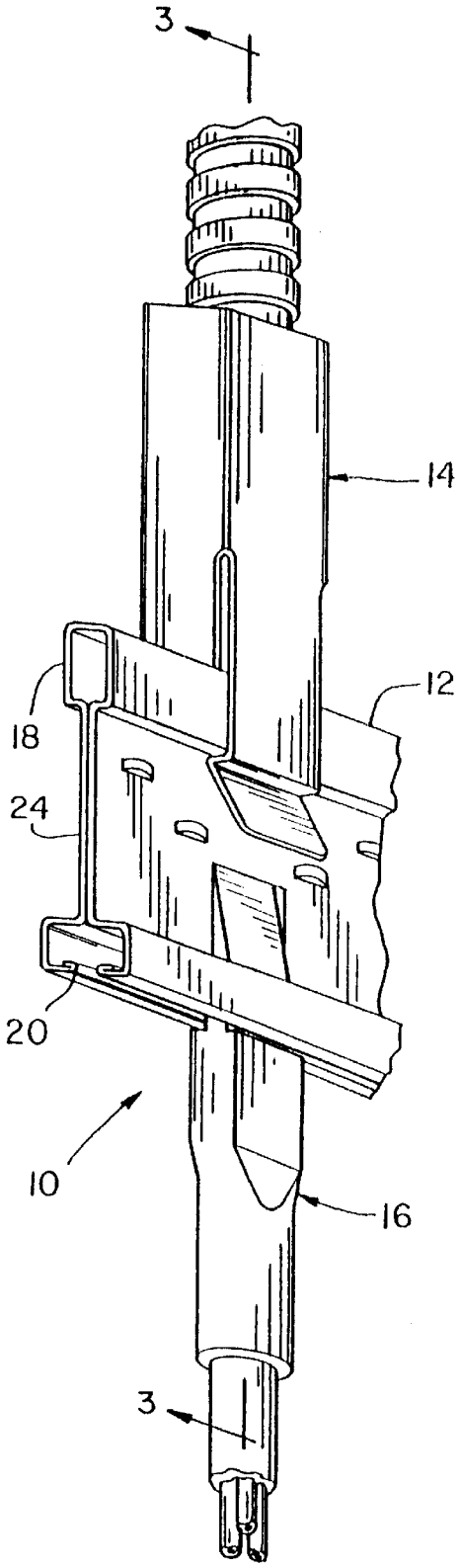
FIG. 2 is an assembled perspective view of the rail connector system of FIG. 1.

Referring now to the drawings, and more particularly to FIGS. 1 and 2, there is shown a rail electrical connector system 10 which generally includes a rail 12, a first electrical connector 14 and a second electrical connector 16.

Rail 12 is an elongated member having a generally 'I' shaped cross-section, including a closed channel 18, an open channel 20, a slot 22, a connecting member 24, an open channel aperture 26 and connecting member aperture 28. Rail 12 allows first electrical connector 14 and second electrical connector 16 to interconnect through rail 12 and to detachably attach to rail 12. Rail 12 may be formed from a folded piece of sheet metal or rail 12 may be an extrusion of plastic or metal. Rail 12 may be a structural member of some other system such as a suspended ceiling.

Closed channel 18 has a generally rectangular cross-section. Closed channel 18 provides strength to rail 12 and the shape allows first electrical connector 14 to attach thereto.

Open channel 20 has a generally rectangular cross-section with slot 22 along one side. On a side opposite slot 22 open channel apertures 26 are positioned to accommodate the passage of second electrical connector 16. Slot 22 and open channel apertures 26 also allow the connection of lighting fixtures to rail 12 as a part of a suspended ceiling system.

Slot 22 extends the full length of rail 12 allowing not only the passage of air and the attachment of lighting fixtures, but allowing second electrical connector 16 to pass therethrough. Connecting member 24 interconnects closed channel 18 and open channel 20. Connecting member apertures 28 extend through connecting member 24. Open channel apertures 26 extend through open channel 20 and are arranged in conjunction with connecting member apertures 28. Connecting member aperture 28 extend through connecting member 24 and are arranged in conjunction with open channel apertures 26. One skilled in the art will recognize how rail 12 can be formed from flat metal stock with apertures 26 and 28 punched therethrough.

Figure 3:
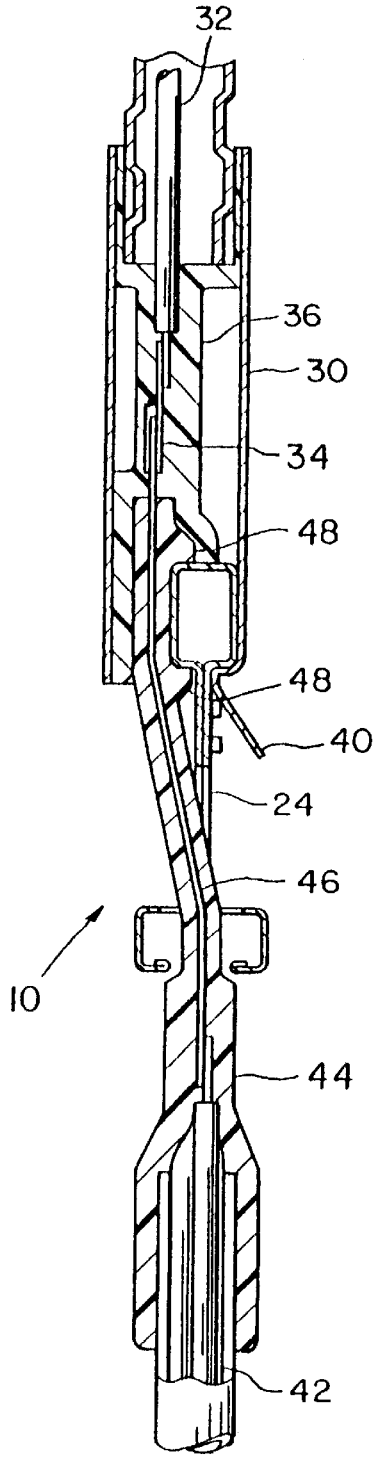
FIG. 3 is a sectioned side view of the rail connector system of FIGS. 1 and 2.
Figure 6:
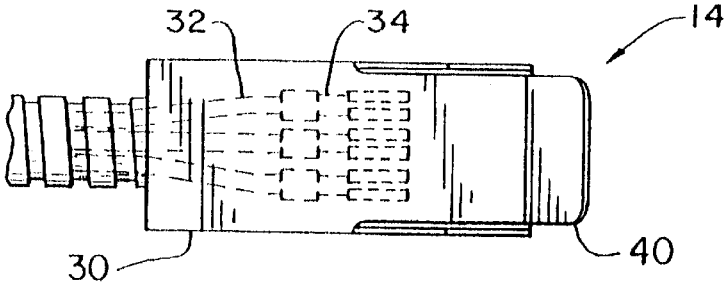
FIG. 6 is a partially sectioned view of a female connector which is a part of the rail connector system of FIGS. 1–3.
Figure 7:
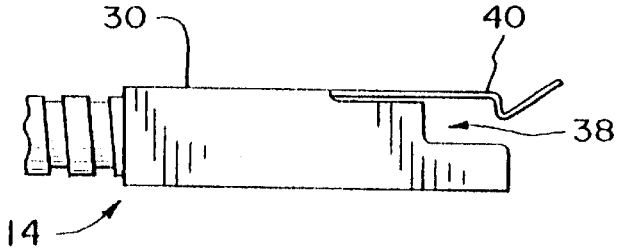
FIG. 7 is another view of the female connector of FIG. 6.

Now, additionally referring to FIGS. 3, 6 and 7, there is depicted first electrical connector 14 including an outer shell 30, electrical conductors 32, female terminals 34 and an inner shell 36. Outer shell 30 has a generally rectangular cross-section and includes notch 38 and spring clip 40. Outer shell 30 provides protection to the portions of electrical connector 14 lying within. Notch 38 is shaped to accommodate the surface of closed channel 18 of rail 12 when installed thereto. Spring clip 40 provides a detachable connection to rail 12 by first electrical connector 14. Spring clip 40 is shaped to allow first electrical connector 14 to be pushed onto rail 12 and to be detached therefrom without the need for tools.

Electrical conductors 32 are in electrical connection with female terminals 34 and a power source (not shown). Electrical conductors 32 are electrically insulated and for power circuits will usually be three in number, one power, one return and one safety ground. Electrical conductors 32 can be contained in a conduit or be otherwise protected. Alternatively, electrical conductors 32 may provide for the transmission of data or telecommunications connections.

Female terminals 34 are in electrical connection with electrical conductors 32 and are disposed within inner shell 36 in a manner so as to engage corresponding male connectors from second electrical connector 16.

Inner shell 36 is positioned substantially within outer shell 30 and is made of nonconductive material. Inner shell 36 is shaped to accommodate the entry and securing of second electrical connector 16.

Figure 4:
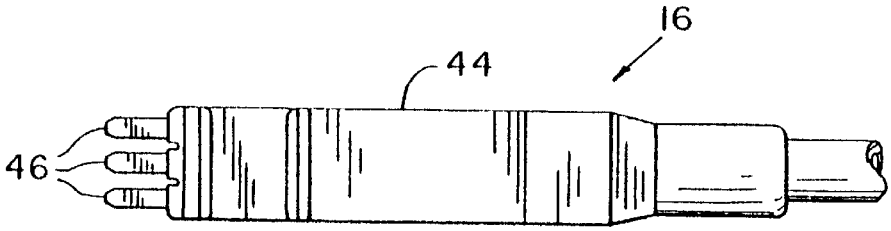
FIG. 4 is a view of a male connector which is a part of the rail connector system of FIGS. 1–3.
Figure 5:
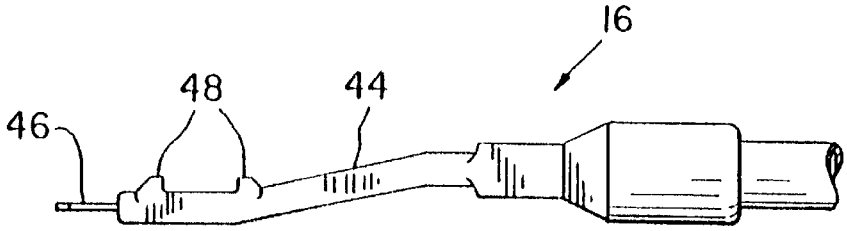
FIG. 5 is another view of the male connector of FIG. 4.

Now, additionally referring to FIGS. 4 and 5, there is depicted second electrical connector 16 including electrical conductors 42, a housing 44, male terminals 46 and protrusions 48. Second electrical connector 16 is offset to accommodate passage through slot 22, open channel aperture 26 and connecting member aperture 28, and to electrically connect to first electrical connector 14.

Electrical conductors 42 are in electrical connection with male terminals 46 and an electrical load or distribution system (not shown). Electrical conductors 42 are electrically insulated and for power circuits will usually be three in number, one power, one return and one safety ground. Electrical conductors 42 can be contained in a conduit or be otherwise protected. Alternatively, electrical conductors 42 may provide for the transmission of data or telecommunications connections.

Housing 44 is made of a molded nonconductive material such as plastic. Housing 44 is shaped with an offsetting bend to accommodate routing through slot 22, open channel aperture 26 and connecting member aperture 28. Housing 44 electrically isolates male terminals 46 from each other.

Male terminals 46 are in electrical connection with electrical conductors 42 and are disposed within housing 44 in a manner so as to engage corresponding female terminals 34 in first electrical connector 14. Male terminals 46 project from an end of housing 44.

Protrusions 48 extend from a side of housing 44 engaging a side of closed channel 18 when second electrical connector 16 is fully engaged in first electrical connector 14. Protrusions 48 provide detachable engagement for second electrical connector 16 with rail 12.

During installation of a rail electrical connector system, rail 12 is installed as a rail of a suspended ceiling system, a purpose of which is to provide support to ceiling tile. Electrical conductors 32 of first electrical connector 14 are terminated at a switched power source, a constant power source, a data line or a telecommunication line. Electrical conductors 42 of second electrical connector 16 are terminated at a lighting fixture, a power receptacle, a data receptacle or a telecommunication receptacle. First electrical connector 14 is attached to closed channel 18 of rail 12 by pushing first electrical connector 14 thereon. Second electrical connector 16 is inserted through slot 22, open channel aperture 26 and connecting member aperture 28 and thereby routing second electrical connector 16 proximate to first electrical connector 14. First electrical connector 14 and second electrical connector 16 are pushed together thereby electrically engaging the two connectors and causing second electrical connector 16 to become attached to rail 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rail electrical connector system, comprising:

a rail having a plurality of apertures therethrough; and two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said plurality of apertures, said first electrical connector holding said second electrical connector against a portion of said rail apart from said plurality of apertures.

2. The system of claim 1, wherein said two electrical connectors further comprise:

a plurality of electrical conductors extending from an end of each of said two electrical connectors;

a plurality of male electrical connectors disposed at least partially within one of said two electrical connectors, said plurality of male electrical connectors being electrically connected to at least one of said plurality of electrical conductors; and a plurality of female electrical connectors disposed at least partially within an other of said two electrical connectors, said plurality of female electrical connectors being electrically connected to at least one of said plurality of electrical conductors.

3. The system of claim 1, wherein said two electrical connectors are configured to accommodate at least one of electrical power, data transmission and telecommunications.

4. The system of claim 1, wherein said two electrical connectors have housings made of a nonconductive material.

5. A rail electrical connector system, comprising:

a rail having a plurality of apertures therethrough, said rail having an I-shaped cross-section; and two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said plurality of apertures.

6. A rail electrical connector system, comprising:

a rail having a plurality of apertures therethrough; and two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said plurality of apertures, said second electrical connector having an offset bend to accommodate routing of said second electrical connector through at least one of said plurality of apertures.

7. A rail electrical connector system, comprising:

a rail having a plurality of apertures therethrough, said rail providing support in a suspended ceiling system; and two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said plurality of apertures.

8. A rail electrical connector system, comprising:

a rail having a plurality of apertures therethrough; and two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said plurality of apertures, said first electrical connector including a spring configured to detachably attach said first electrical connector to said rail.

9. A method of installing a rail electrical connector system, comprising the steps of:

installing a rail as part of a suspended ceiling, said rail having a plurality of apertures therethrough;

attaching a first electrical connector to said rail;

inserting a second electrical connector through at least one of said plurality of apertures;

positioning an end of said second electrical connector against a side of said rail; and electrically engaging said first electrical connector and said second electrical connector.

10. The method of claim 9, further comprising the steps of: connecting electrical conductors from said first electrical connector to a power source; and connecting electrical conductors from said second electrical connector to a light fixture.

11. The method of claim 9, further comprising the steps of:

connecting electrical conductors from said first electrical connector to one of a data line and a telecommunication line; and connecting electrical conductors from said second electrical connector to one of a data receptacle and a telecommunication receptacle.

12. A method of installing a rail electrical connector system, comprising the steps of:

installing a rail as part of a suspended ceiling, said rail having a plurality of apertures therethrough;

attaching a first electrical connector to said rail;

inserting a second electrical connector through at least one of said plurality of apertures said second electrical connector being offset to accommodate said apertures; and electrically engaging said first electrical connector and said second electrical connector.

13. An electrical connector system, for connection through at least one aperture in a rail electrical connector system, said electrical connector system comprising two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said at least one aperture, said first electrical connector holding said second electrical connector against a portion of said rail apart from said plurality of apertures.

14. The system of claim 13, wherein said two electrical connectors further comprise:

a plurality of electrical conductors extending from an end of each of said two electrical connectors;

a plurality of male electrical connectors disposed at least partially within one of said two electrical connectors, said plurality of male electrical connectors being electrically connected to at least one of said plurality of electrical conductors; and a plurality of female electrical connectors disposed at least partially within an other of said two electrical connectors, said plurality of female electrical connectors being electrically connected to at least one of said plurality of electrical conductors.

15. The system of claim 13, wherein said two electrical connectors are configured to accommodate at least one of electrical power, data transmission and telecommunications.

16. The system of claim 13, wherein said two electrical connectors have housings made of a nonconductive material.

17. An electrical connector system, for connection through at least one aperture in a rail electrical connector system, said electrical connector system comprising two electrical connectors including a first electrical connector and a second electrical connector, said first electrical connector detachably mateable to said second electrical connector, said first electrical connector and said second electrical connector removably connected to said rail, said second electrical connector having an offset bend to accommodate routing of said second electrical connector through said at least one aperture.

18. An electrical connector system, for connection through at least one aperture in a rail electrical connector system, said electrical connector system comprising two electrical connectors including a first electrical connector and a second electrical connector, said first electrical connector detachably mateable to said second electrical connector, said first electrical connector and said second electrical connector removably connected to said rail, at least one of said two electrical connectors being routed through at least one of said at least one aperture, said first electrical connector including a spring configured to detachably attach said first electrical connector to said rail.

* * * * *